United States Patent [19]

Oku et al.

[11] Patent Number: 4,597,957

[45] Date of Patent: Jul. 1, 1986

[54] PROCESS FOR ELECTROLYTICALLY PRODUCING METALLIC OXIDE FOR FERRITE

[75] Inventors: Koichi Oku, Matsudo; Kiyoshi Matsuura, Kiryu, both of Japan

[73] Assignee: Japan Metals and Chemicals Co., Ltd., Tokyo, Japan

[21] Appl. No.: 707,250

[22] Filed: Mar. 4, 1985

[30] Foreign Application Priority Data

| | | | |
|---|---|---|---|
| Mar. 6, 1984 | [JP] | Japan | 59-42548 |
| Apr. 13, 1984 | [JP] | Japan | 59-74615 |
| Dec. 20, 1984 | [JP] | Japan | 59-268783 |
| Jan. 28, 1985 | [JP] | Japan | 60-13943 |

[51] Int. Cl.[4] ..... C01G 49/00

[52] U.S. Cl. ..... 423/594; 423/140; 423/593; 204/96; 204/100

[58] Field of Search ..... 204/96, 100; 423/140, 423/594, 593

[56] References Cited

U.S. PATENT DOCUMENTS

| | | | |
|---|---|---|---|
| 3,466,234 | 9/1969 | Cohen et al. | 204/96 |
| 3,951,765 | 4/1976 | Everett | 204/96 |
| 3,960,695 | 6/1976 | Roller | 204/96 |

*Primary Examiner*—R. L. Andrews

*Attorney, Agent, or Firm*—Parkhurst & Oliff

[57] ABSTRACT

A process for electrolytically producing a metallic oxide for a ferrite comprising the steps of electrolyzing an inorganic ammonium salt solution of 2–20% containing 0.01–5% of fluoride compound as an electrode with metals or mixture of metals necessary for producing the ferrite as an anode and graphite as a cathode to produce the hydroxide of the metal used as the anode, oxidizing and separating the hydroxide, and then drying and calcining the hydroxide. Thus, a low silica metal oxide of uniform composition is produced by mixing the composition of a ferrite to be produced with iron and/or manganese or iron and/or manganese in case of producing the metal oxide for the ferrite, and electrolyzing various metal with the resultant mixture as an anode.

17 Claims, No Drawings

PROCESS FOR ELECTROLYTICALLY PRODUCING METALLIC OXIDE FOR FERRITE

BACKGROUND OF THE INVENTION

This invention relates to a process for electrolytically producing a low silica metallic oxide as a raw material of Mn-Zn ferrite, Mg ferrite, Fe-Zn ferrite to be or Fe-Ni ferrite used for various types of magnetic materials.

Oxide ferrites are widely used industrially as magnetic materials. The chemical composition of the oxide ferrite includes $MO.M'_2O_3$, where M generally signifies a two-valency metal such as, for example, iron, manganese, zinc, magnesium, nickel, cobalt, copper, lead, cadmium, barium, or strontium, and M' signifies a three-valency metal usually iron. The oxides of these metals are coupled by in a one to one molar ratio (e.g., in the ferrite oxide one moleof two-valency metallic oxide (MO) and one mole of three-valency metallic oxide ($M'_2O_3$) are coupled in a 1:1 molar ratio), and normally called "a spinel type structure".

When the oxide ferrite is industrially produced, the metal oxide is finely pulverized, adequate amounts are mixed, molded, and calcined. It is well known that the purity of the metal oxide of raw materials for the ferrite largely affects the magnetic performance of the ferrite. Particularly, since silica in the raw material for the ferrite deteriorates the performance of the ferrite, a low silica magnetic material is needed but cannot be produced according to conventional processes. Various processes for producing the low silica metal oxides have been proposed.

For instance, an iron sulfate process which presently is most widely adopted for the treatment of an iron oxide, recrystallizes an iron sulfate and refines the recrystalized iron sulfate. However, ferrous sulfate crystallized by this process unavoidably includes a mother liquor. The ferrous sulfate must be washed with water to remove the mother liquor. Furthermore, the recrystallization must be repeated several times since the crystallized ferrous sulfate is melted, by washing with water. This results in an extremely inefficient and uneconomical process.

Another known process for isolating and removing silicon oxide $SiO_2$ from a raw material solution includes oxidizing or treating the solution with a sulfuric acid solution while heating under pressure, washing with water, separating and removing the silicon oxide by adding a high molecular weight flocculant to the solution to flocculate the silicon oxide, and then filtering and separating the silicon oxide. A process for separating and removing silicon oxide from an iron chloride solution by partially extracting the silicon oxide by a solvent extraction process and distilling it is also known.

The above-described processes all necessitate the use of particular additives such as the high molecular weight flocculant or the extracting solvent to separate and remove the silicon oxide. These processes also require special equipment such as a pressurizing device. These processes, therefore, have drawbacks such as complicated process steps and high cost. In addition, according to these processes, the silicon oxide content can be reduced to approx. 70 ppm, but it is difficult to reduce the silicon oxide content to 70 ppm or lower.

Consequently, in order to produce ferrite with a content of silicon oxide of 70 ppm or lower previously electrolytic iron had to be dissolved in nitric acid to form iron nitride or to produce ferrite with a silicon oxide content of 30 to 50 ppm ferric oxide by it was necessary to thermally decompose high purity iron oxalate using ferric oxide. These processes are very expensive.

It is also known to produce low silica ferrite (e.g., $Mn_{0.5}Zn_{0.5}Fe_2O_4$; $Ni_{0.5}Zn_{0.5}Fe_2O_4$, etc.), by mixing oxide powders of low silica manganese, zinc, magnesium, nickel, barium or strontium with low silica ferric oxide, molding the mixture and calcining.

However, even when metal oxides such as manganese or zinc are mixed with iron oxide or iron manganese composite oxide, the grain size of the metal oxide is irregular, the mixture cannot be uniformly mixed mechanically, and when the mixture is calcined into a ferrite, the ferrite is irregular in its performance.

SUMMARY OF THE INVENTION

An object of the present invention is to provide a process for producing a low silica metal oxide of uniform composition. The objective is achieved by mixing the composition of a ferrite to be produced with iron and/or manganese in case of producing the metal oxide for the ferrite, and electrolyzing various metal with the resultant mixture as an anode.

The present invention provides a process for electrolytically producing a metal oxide which comprises electrolyzing an inorganic ammonium salt solution of 2–20% containing 0.01–5% of fluoride with a mixture of a metal of iron and/or manganese or at least one metal selected from a group consisting of zinc, magnesium, nickel, cobalt, copper, lead, cadmium, barium and strontium with iron and/or manganese as an anode and a graphite as a cathode.

The metal raw material used as the anode may use metal of pig iron, steel, or steel chips as an iron source, a metallic manganese as a manganese source, various ferromanganeses or zinc, magnesium, nickel, cobalt, copper, lead, cadmium, barium or strontium. The metals to be mixed with the iron and/or manganese are not limited to the particular metals descriged above, but may be applied to those used as ferrite.

The mixture of the metal is formed in advance as an alloy, or the various metals merely mixed and are contained in a basket as an anode. The metals such as zinc, magnesium or nickel are of a smaller quantity than iron and manganese. Accordingly, they may be uniformly mixed by laminating them on the surface of the iron steel or ferromanganese. The metals such as manganese, zinc or magnesium may be electrolyzed in a state in which they are partially dissolved in an electrolyte solution.

The electrolyte used is an inorganic ammonium salt preferably in an aqueous solution which contains 2 to 20% of $NH_4Cl$, mixed with fluoride compounds. The fluoride compounds are dissolved in the aqueous solution preferably to form fluorine ions. To this end, $NH_4F$, NaF or KF may be used, but $NH_4F$ the most effective in removing the silicon oxide from the oxide.

The ammonium chloride solution, containing $NH_4Cl$ as an electrolyte, advantageously has lower bath voltage at the time of electrolysis when the concentration of $NH_4Cl$ is higher. On the other hand, the load applied to the washing step is greater. Accordingly the concentration $NH_4Cl$ is set to 20% or lower. When the $NH_4Cl$ concentration is 2% or lower, the bath voltage increases and the alkali produced becomes insufficient. Accordingly, the concentration of the ammonium chloride solution is set to 2 to 20%.

The amount of the fluoride to be added to the aqueous ammonium chloride solution is set to 0.01–5%. When 0.01% or less of fluoride is added, the silicon oxide in the metal oxide cannot be reduced to 30 ppm or less, while when 5% or higher of fluoride is added, the fluorine ions contribute to the electrolysis, with the result that the solute of iron and manganese descreases, thereby resulting in the deterioration in the current efficiency.

A membrane is inserted between the anode and the cathode, and the electrolysis is performed with a current density of 4–11 A/dm$^2$ at ambient temperatures and electrolytic voltage of 1.5–10 V.

In order to perform the electrolysis of the present invention, the membrane mounted between the anode and the cathode is preferably a membrane having anionic exchangeability.

More particularly, when a membrane of brown ware is used, metallic ions produced from the anode are introduced into the cathode side by diffusion, and adhere to the side surface of the cathode of the membrane as the precipitate of the hydroxide. In addition, the metallic ions are electrodeposited on the cathode, thereby reducing the current efficiency. In order to avoid the abovementioned phenomenon, a membrane which has anionic exchangeability is used. A membrane which has anionic exchangeability means a membrane which will selectively permeate only anionic ions.

When the membrane having the anionic exchangeability is used as described above, metallic ions originally produced from the anode permeate the membrane to the cathode side. In the present invention, halogenide is contained in the electrolyte. The metallic ions produced from the anode react with the halogen ions in the electrolyte to form halogen complex ions. Since the charge of the complex becomes negative, the metallic ions do not permeate to the cathode side, and the soluted metal might not be electrodeposited on the cathode.

In the present invention, the silicon oxide, other various nonmetallic intermediate and elements of impurities are separated during the electrolysis step by a suitable voltage selection at the time of electrolysis, and can be removed as anode slime. Accordingly, the silicon oxide may be reduced to 30 ppm or lower, and the metallic hydroxide having less nonmetallic intermediate can be provided.

The hydroxide produced by the abovementioned process is oxidized and separated, then dried and calacined to metallic oxide which contains 30 ppm of less of the silicon oxide.

Since the metallic oxide can simultaneously provide the final ferrite raw material by electrolytically producing the mixture of the various types of metallic oxide with an iron of the composition of the final ferrite with the manganese, zinc, magnesium or as required, the production efficiency can be largely improved.

Further, the metallic oxide to be obtained can be produced by electrolysis uniformly without segregation, and a uniform product having no irregularity in performance can be inexpensively provided.

Moreover, the iron source and the manganese source used as the magntic material are necessarily finely pulverized, in general to 0.6–2 microns. This pulverization requires a lot of time a large quantity of energy and it is noisy. The present invention by employing electrolysis, avoids these disadvantages.

In order to reduce the silicon oxide in the metallic oxide of the final product to 30 ppm or less, the current density at the time of electrolysis is desirably 4–11 A/dm$^2$. It is dificult to sufficiently reduce the silicon oxide content when the current density is lower than 4 A/dm$^2$. When the current density is 11 A/dm$^2$ or higher, the process is not economical.

According to the present invention, as described above, when the raw material for various types of ferrite is produced, the anode is formed of one or more metals such as manganese, zinc and magnesium mixed with the iron in response to the composition of the ferrite desired as the final product. The electrolysis is then executed to simultaneously produce the final ferrite. The production efficiency is largely improved, and the silicon oxide content of the final product can be reduced to 20 ppm, and the raw material for the ferrite of the uniform composition can be inexpensively provided.

DESCRIPTION OF THE PREFERRED EMBODIMENTS

Examples of the process of the present invention will be described.

EXAMPLE

Particular metal (having a 3–5 mm of grain size) formed of the composition shown in Table 1 was filled in a basket as an anode, a graphite was used as a cathode. A membrane of brown ware was mounted between the anode and the cathode in an electrolytic tank (having 4 liters of volume) for the electrolysis.

After the electrolysis is finished, the valve under the anode and cathode sides which were partitioned by a membrane was opened to remove the electrolyte of both electrodes, the electrolyte of cathode side was added to the electrolyte of anode side to prepare pH, and metallic ions in the electrolyte are formed to hydroxide while agitating.

Then, hydrogen peroxide (31%) was added to the hydroxide, vigorously stirred, allowed to stand for, precipitate was filtered and recovered, and the filtrate was simultaneously recovered. This filtrate was circulated and used as electrolyte.

The precipitate was washed with water which was sufficiently weak alkaline, dried at 110° C. for 10 hours, heated and calcined at 800° C. for 5 hours in an air atmosphere, then pulverized to produce the final product.

The composition of the bath and the electrolytic conditions at the electrolyzing time are listed in Table 2 and the composition of the final product is listed in Table 3.

TABLE 1

| | (Mixture parts) | | | | | | |
|---|---|---|---|---|---|---|---|
| Experiment No. | Iron | FMnH | Zn | Mg | Ni | Ba | Sr |
| 1 | 61 | 32 | 7 | — | — | — | — |
| 2 | 65 | — | 15 | — | 20 | — | — |
| 3 | 83 | — | — | — | — | 17 | — |
| 4 | 88 | — | — | — | — | — | 12 |
| 5 | 61 | 32 | — | 7 | — | — | — |
| 6 | 100 | — | — | — | — | — | — |
| 7 | — | 100 | — | — | — | — | — |

TABLE 2

| Experiment No. | Bath composition (%) $NH_4Cl$ | $NH_4F$ | Electrolytic conditions Bath voltage | Time (hr) | Current density ($A/dm^2$) | Current efficiency (%) |
|---|---|---|---|---|---|---|
| 1 | 10 | 0.5 | 2.30–2.40 | 5.0 | 7.5 | 70.8 |
| 2 | 10 | 0.5 | 1.90–2.20 | 4.5 | 7.5 | 74.3 |
| 3 | 10 | 0.5 | 1.80–2.30 | 4.5 | 6.0 | 76.8 |
| 4 | 10 | 0.5 | 1.90–2.15 | 6.0 | 6.0 | 73.2 |
| 5 | 10 | 0.5 | 1.95–2.50 | 6.0 | 7.0 | 68.2 |
| 6 | 10 | 0.5 | 2.00–2.30 | 6.0 | 5.0 | 78.3 |
| 7 | 10 | 0.5 | 2.10–2.35 | 6.0 | 7.0 | 73.5 |

TABLE 3

| Experiment No. | (Product composition %) $Fe_2O_3$ | M | ZnO | MgO | NiO | BaO | Sr | $SiO_2$ (ppm) |
|---|---|---|---|---|---|---|---|---|
| 1 | 67.99 | 21.80 | 6.79 | — | — | — | — | 9 |
| 2 | 64.02 | — | 14.80 | — | 19.70 | — | — | 15 |
| 3 | 81.50 | — | — | — | — | 14.77 | — | 13 |
| 4 | 88.35 | — | — | — | — | — | 10.50 | 10 |
| 5 | 67.10 | 21.43 | — | 6.89 | — | — | — | 20 |
| 6 | 99.80 | — | — | — | — | — | — | 19 |
| 7 | 21.80 | 77.50 | — | — | — | — | — | 17 |

The bath composition and the electrolytic conditions at the electrolyzing time by using the same anode as in experiments 1 to 7 and using the membrane with anionic exchangeability are listed in Table 4, and the composition of the final product is listed in Table 5.

TABLE 4

| Experiment No. | Bath composition (%) $NH_4Cl$ | $NH_4F$ | Electrolytic conditions Bath voltage | Time (hr) | Current density ($A/dm^2$) | Current efficiency (%) |
|---|---|---|---|---|---|---|
| 1 | 10 | 0.5 | 2.00–2.10 | 5.0 | 7.5 | 93.5 |
| 2 | 10 | 0.5 | 1.75–1.95 | 4.5 | 7.5 | 92.1 |
| 3 | 10 | 0.5 | 1.80–2.10 | 4.5 | 6.0 | 95.8 |
| 4 | 10 | 0.5 | 1.90–2.05 | 6.0 | 6.0 | 94.5 |
| 5 | 10 | 0.5 | 1.95–2.20 | 6.0 | 7.0 | 97.8 |
| 6 | 10 | 0.5 | 1.70–1.60 | 6.0 | 5.0 | 95.6 |
| 7 | 10 | 0.5 | 2.05–2.20 | 6.0 | 7.0 | 92.8 |

TABLE 5

| Experiment No. | (Product composition %) $Fe_2O_3$ | M | ZnO | MgO | NiO | BaO | Sr | $SiO_2$ (ppm) |
|---|---|---|---|---|---|---|---|---|
| 1 | 68.97 | 22.81 | 6.82 | — | — | — | — | 11 |
| 2 | 63.92 | — | 14.79 | — | 20.01 | — | — | 14 |
| 3 | 82.88 | — | — | — | — | 15.93 | — | 10 |
| 4 | 88.30 | — | — | — | — | — | 10.31 | 9 |
| 5 | 67.20 | 22.63 | — | 6.91 | — | — | — | 17 |
| 6 | 99.89 | — | — | — | — | — | — | 16 |
| 7 | 22.60 | 77.20 | — | — | — | — | — | 8 |

As is apparent from the results in Table 2, the process of the present invention provides current efficiency, while producing a product of various types of ferrite as listed in Table 3, and yet can reduce the silicon oxide content to 20 ppm or less.

Furthermore, when the membrane having anionic exchangeability at the electrolyzing time is mounted, the current efficiency is improved to 90% or higher as listed in Table 4.

Moreover, the silicon oxide content in the final product of this case is recognized to be 17 ppm or less from the Table 5.

What is claimed is:

1. A process for electrolytically producing a metal oxide of ferrite comprising:

forming a solution comprising 2% to 20% of an inorganic ammonium salt and .01% to 5% of a fluoride compound, said solution functioning as an electrolytye;

separating said solution into an anode side and a cathode side using a membrane which has anionic exchangeability;

electrolyzing said solution using an anode and a cathode, said anode comprising at least one first metal and at least one second metal, said at least one first metal being selected from the group consisting of zinc, magnesium, nickel, cobalt, copper, lead, cadmium, barium and strontium, said at least one second metal being selected from the group consisting of iron and manganese, said cathode comprising graphite, said first and second metals of said anode being dissolved into said solution on said anode side during said electrolysis;

combining said solution from said anode side with said solution from said cathode side after said electrolysis to form a solution containing a hydroxide of said first and second metal dissolved from said anode;

adding hydrogen peroxide to the solution containing the hydroxide of said metal to oxidize said metal and to produce a precipitate of a metal of ferrite;

filtering said precipitate;

drying said precipitate; and calcining said precipitate to form a metal oxide.

2. The process of claim 1, wherein said solution further comprises at least one member selected from the group consisting of zinc, magnesium, nickel, cobalt, copper, lead, cadmium, barium and strontium.

3. The process of claim 1, wherein said flouride compound is selected from the group consisting of $NH_4F$, NaF, and KF.

4. The process of claim 1, wherein said inorganic ammonium salt is selected from the group consisting of $NH_4Cl$, $(NH_4)_2SO_4$, $NH_4NO_3$ and ammonium acetate.

5. A process for forming a metal oxide comprising the steps of:

(a) forming a solution of an inorganic ammonium salt and a flouride compound;

(b) electrolyzing said solution using said solution as an electrolyte, using a metal as an anode, and using a cathode, said metal dissolving to form a hydroxide;

(c) oxidizing said hydroxide to form a precipitate of metal hydroxide;

(d) separating said precipitate;

(e) drying said precipitate; and (f) calcining said precipitate to form a metal oxide.

6. The process for forming a metal oxide according to claim 5, wherein said solution comprises 2% to 20% of said inorganic ammonium salt and 0.01% to 5% of said fluoride compound.

7. The process for forming a metal oxide according to claim 6, wherein said fluoride compound is selected from the group consisting of $NH_4F$, NaF and KF.

8. The process for forming a metal oxide according to claim 6, wherein said inorganic ammonium salt is selected from the group consisting of $NH_4Cl$, $(NH_4)_2SO_4$, $NH_4NO_3$ and ammonium acetate.

9. The process for forming a metal oxide according to claim 6, wherein said solution further comprises at least one member selected from the group consisting of zinc, magnesium, nickel, cobalt, copper, lead, cadmium, barium and strontium.

10. The process for forming a metal oxide according to claim 5, wherein said metal used as an anode comprises at least one first metal and at least one second metal, said at least one first metal being selected from the group consisting of zinc, magnesium, nickel, cobalt, copper, lead, cadmium, barium and strontium, said at least one second metal being selected from the group consisting of iron and manganese, said cathode comprising graphite.

11. The process of forming a metal oxide according to claim 5, wherein before said electrolyzing said solution is separated into an anode side and a cathode side using a membrane which has anionic exchangebility.

12. A process for electrolytically producing a metallic oxide of ferrite comprising the steps of:

electrolyzing a solution using an electrolyte, an anode, and a cathode, said electrolyte comprising 2% to 20% of an inorganic ammonium salt and 0.01% to 5% of a fluoride compound, said anode comprising at least one metal, which dissolves during said electrolysis;

oxidizing to form a precipitate of a metal hydroxide;

separating said metal hydroxide precipitate; and drying and calcining said metal hydroxide of ferrite to form a metal oxide of ferrite.

13. The process for electrolytically producing a metallic oxide of ferrite according to claim 12, wherein said at least one metal comprises a first metal and a second metal, said first metal being selected from the group consisting of zinc, magnesium, nickel, cobalt, copper, lead, cadmium, barium and strontium, said second metal being selected from the group consisting of iron and manganese.

14. The process for electrolytically producing a metallic oxide of ferrite according to claim 12, wherein said solution further comprises at least one member selected from the group consisting of zinc, magnesium, nickel, cobalt, copper, lead, cadmium, barium and strontium.

15. The process for electrolytically producing a metallic oxide of ferrite according to claim 12, wherein said solution is separated by a membrane into an anode side and a cathode side, said membrane having an ionic exchangeability.

16. The process for electrolytically producing a metallic oxide of ferrite according to claim 12, wherein said fluoride compound is selected from the group consisting of $NH_4F$, NaF and KF.

17. The process for electrolytically producing a metallic oxide of ferrite according to claim 12, wherein said inorganic amonium salt is selected from the group consisting of $NH_4Cl$, $(NH_4)_2SO_4$, $NH_4NO_3$ and ammonium acetate.

* * * * *